US005482643A

United States Patent [19]

Chambers et al.

[11] Patent Number: 5,482,643

[45] Date of Patent: Jan. 9, 1996

[54] SOAP BARS MADE WITH TERNARY SYSTEM OF FATTY ISETHIONATE ESTER, FATTY ACID, AND WATER

[75] Inventors: John G. Chambers; Geoffrey Trlam, both of Merseyside, Great Britain

[73] Assignee: Lever Brothers Company, DIvision of Conopco, Inc., New York, N.Y.

[21] Appl. No.: 246,047

[22] Filed: May 18, 1994

[30] Foreign Application Priority Data

May 19, 1993 [GB] United Kingdom ..... 9310323

[51] Int. Cl.[6] ..... C11D 1/755; C11D 3/20; C11D 3/34; C11D 1/04

[52] U.S. Cl. ..... 252/121; 252/108; 252/132; 252/134; 252/DIG. 4; 252/DIG. 14; 252/ DIG. 16; 252/173

[58] Field of Search ..... 252/DIG. 16, 108, 252/121, DIG. 4, 132, 134, DIG. 14, 173

[56] References Cited

U.S. PATENT DOCUMENTS

| | | | |
|---|---|---|---|
| 2,894,912 | 7/1959 | Geitz | 252/121 |
| 3,376,229 | 4/1968 | Haass | 252/121 X |
| 4,234,464 | 11/1980 | Morshauser | 252/DIG. 16 |
| 4,536,338 | 8/1985 | Urban et al. | 260/400 |
| 4,707,288 | 11/1987 | Irlam et al. | 252/121 |
| 5,030,376 | 7/1991 | Lee et al. | 252/121 X |
| 5,284,598 | 2/1994 | Subramanyam et al. | 252/121 |

FOREIGN PATENT DOCUMENTS

| | | |
|---|---|---|
| 249474 | 12/1987 | European Pat. Off. . |
| 434460 | 6/1991 | European Pat. Off. . |
| 0472320 | 2/1992 | European Pat. Off. . |
| 537964 | 4/1993 | European Pat. Off. . |
| 2285452 | 4/1976 | France . |
| 1294754 | 1/1972 | United Kingdom . |
| 1381773 | 1/1975 | United Kingdom . |
| 90/13283 | 11/1990 | WIPO . |
| 93/06205 | 4/1993 | WIPO . |

*Primary Examiner*—Douglas J. McGinty
*Attorney, Agent, or Firm*—Ronald A. Koatz

[57] ABSTRACT

Formation of soap bars comprising fatty isethionate esters and fatty acid can be achieved without an energetic mixing step by forming an isotropic solution of the fatty isethionate ester, fatty acid and water.

3 Claims, 3 Drawing Sheets

Figure 1:
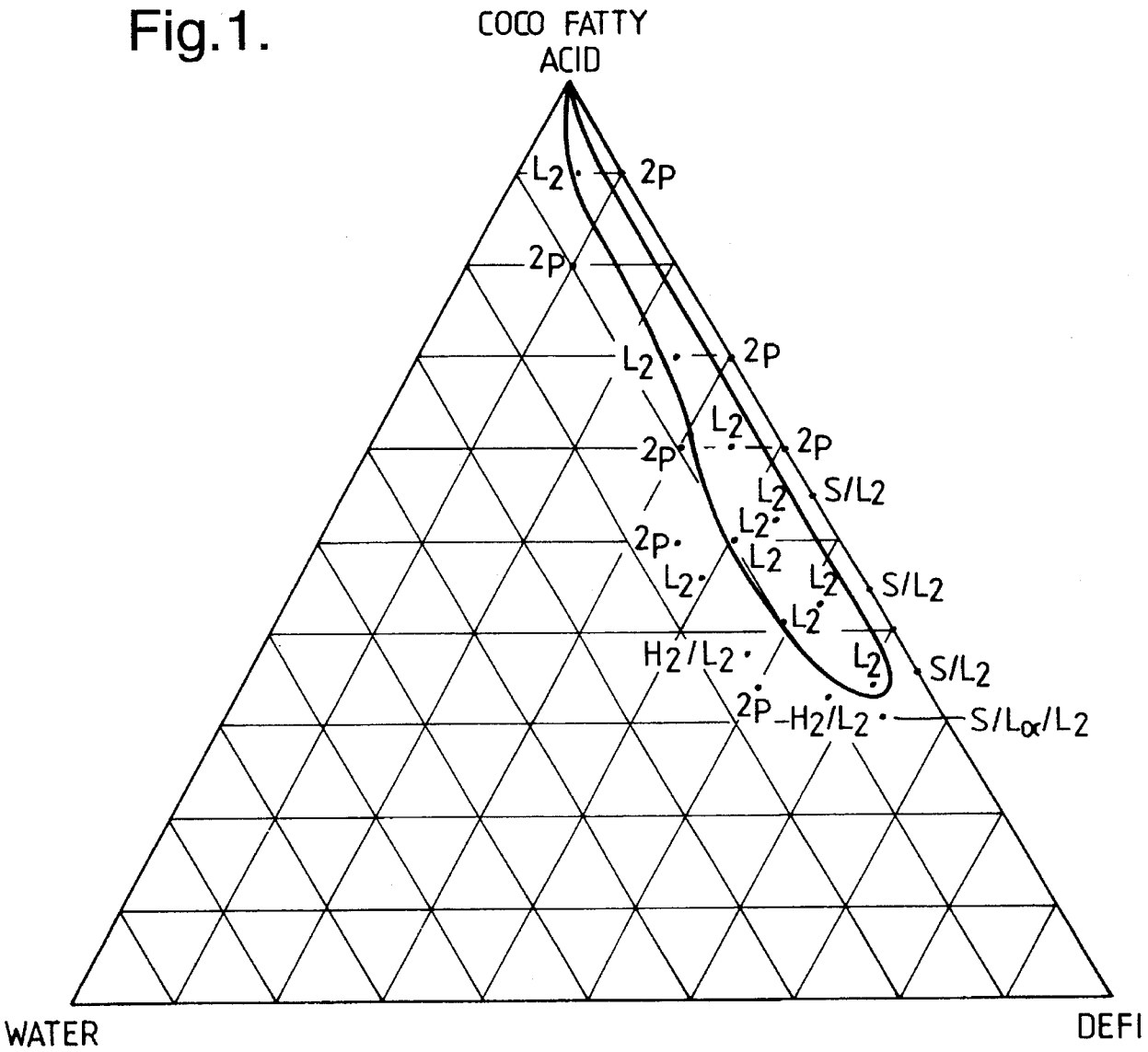

SOAP BARS MADE WITH TERNARY SYSTEM OF FATTY ISETHIONATE ESTER, FATTY ACID, AND WATER

The present invention relates to improved soap bars and in particular to soap bars comprising synthetic surfactant components in addition to fatty acid soaps.

Soap bars are known from antiquity. Fatty acid soaps are however relatively harsh surfactants and much effort has been expended in formulating mild soap bars by replacement of a portion of the soap with other surfactant components.

Mild soap bars are generally manufactured from a feedstock comprising neat soap and one or more synthetic co-active components. These are combined together in an intimate mixture and formed into bars.

Soap plants typically comprise a plurality of mixing, working, heating and cooling apparatus for the treatment of the feedstock. The heating apparatus conventionally comprises steam jacket and steam injection apparatus. By use of super-heated steam it is practical to raise the temperature of components to, at most, 150° C. To reach temperatures in excess of 150° C., specialised apparatus must be employed. Consequently, for reasons of economy, the hot portions of soap plants normally operate at maximum temperatures in the range 100°–130° C., and have normal operating temperatures in the range 85°–95° C.

Certain types of mild soap bar include synthetic co-active components which require high temperatures, typically in excess of 100° C., to enter a molten state. Amongst these high melting components are the so-called 'fatty isethionate esters', which become pumpable only above 100°– 150° C. One advantage of using these high melting components is that they give structure to the eventual bar. Other, low melting, liquid or highly soluble synthetic components, such as sodium lauryl ether sulphate and alkyl glyceryl ether sulphate are known, but do not provide structure in the eventual product: these products require additional structuring agents such as polymers, long chain fatty acids, and electrolytes the presence of which can interfere with the lather performance of the soap bar and add to the cost of the product.

Fatty isethionate esters are typically used in soap bar products at levels of around 25 to 70% wt. At very low levels of fatty isethionate, i.e. well below 30% on product, mildness benefits, somewhat reduced, are still obtained. At higher levels of fatty isethionate, i.e. above 70%, products become unprocessable due to the physical properties of the fatty isethionate, leading to a product which is too hard to process.

As the aforementioned melting points of 100°–150° C. are at or above the upper limits of the operating temperature of the plant, energetic mixing at a temperature of around 70° C. is used in order to form an intimate mixture of these components with the balance of the components of the bar so as to avoid the formation of a gritty product. Moreover, significant hydrolysis of the isethionates begins to occur at temperatures above 110° C.

One problem with the energetic mixing step is that it must generally be conducted as a batch operation or, where semi-continuous operation is desired, a plurality of mixers may be employed in a phased, parallel, batch process. Alternatives to batch operation have included re-cycling of a large portion of the product such that it passes through the mixer more than once. Other alternatives have included the use of highly specialised mixers of the cavity transfer type which, while being sufficiently energetic, are also capable of one-pass mixing. These alternatives to the use of conventional batch mixers have proved expensive to install and operate.

We have now determined how the required intimate mixture may be formed without use of energetic mixing. We have determined that by formation of an isotropic solution of a fatty isethionate ester, fatty acid and a relatively small amount of water, the energetic mixing step can be avoided while the process temperature need not exceed 130° C.

According to a first aspect of the present invention there is provided a liquid isotropic mixture comprising:

a) a first surfactant component having a $T_c$ in excess of 15° C., b) fatty acid in an amount such that the ratio of first surfactant component to fatty acid is not more than 2:1, and, c) 2–15% water.

The $T_c$ is the minimum temperature above which the first surfactant component forms a liquid crystalline phase: i.e. the $T_c$ of a material indicates the lowest temperature at which significant quantities of the material will dissolve in water.

Under factory and transport conditions components having a $T_c$ below 15° C. will generally be treated as liquids, whereas components having a $T_c$ above 15° C. will generally exhibit the properties of, and be handled as, solids.

Generally, the first surfactant component will be a fatty isethionate ester.

Commercially available fatty isethionate esters typically have $T_c$ values above 30° C. These values are high compared with surfactants such as sodium lauryl ether sulphates (SLES), a polyoxyethylated surfactant with an average of three ethoxy units per molecule: which has a $T_c$ of less than 0° C. and Disodium lauryl monethoxy-sulphosuccinate (DMLS) again having a $T_c$ value less than 0° C.: i.e. both SLES and DLMS can be handled as liquids.

Typically, the fatty isethionate ester (component a) is an ester of fatty acids having $C_{10}$–$C_{18}$ average chain length with isethionates. Mixed esters of fats obtained from the saponification of coconut and other vegetable oils and fats, and fractions thereof are particularly preferred.

Cocoyl isethionate, comprising fatty acid residues containing a high proportion of lauric acid residues is the most preferred isethionate for use in the embodiments of the present invention. This material ms available from many sources, including Mazer (as the 'Jordapon Series' [TM]), GAF (as Fenopon [TM] AC78 and AM78), AKZO (as Elfan [TM] AT84 and 84G), Hoechst (as Hostapon [TM] KA and Hoe S 3390-2), ICI (as Arlatone [TM] SCI and Tensianol [TM] 399 series) and Finerex (as Tauranol series surfactants).

Generally, the fatty acid (component b) comprises one or more fatty acids obtained from vegetable or animal oils and fats. Mixtures of fatty acids having an average chain length of $C_8$–$C_{20}$ are preferred. In particular, fatty acids with chain lengths of $C_{10}$–$C_{14}$ as these are simple to process due to their relatively low melting point. Fatty acids with $C_{16}$–$C_{18}$ chains are more difficult to process but have a better bar structuring effect due to their higher melting points. Most preferable are saturated fatty acids as these are chemically more stable than the corresponding unsaturates.

Typical sources of suitable fatty acids are tallow, palm, lard, tallow stearines and palm stearines, soya bean oil, sunflower oil, linseed oil, rice bran oil and lauric oils, such as coconut, palm kernel, babassu and other palm nut oils rich in laurics.

Permissible ratios of components (a), (b) and (c) are defined by reference to a phase diagram as elaborated upon hereafter. If the ratio of first surfactant component to fatty acid exceeds 2:1, products are formed which are non-homogeneous and difficult to process due to phase separation.

According to a second aspect of the present invention there is provided a process for the manufacture of soap bars which includes the step of forming a liquid isotropic mixture comprising:

a) a fatty isethionate ester, b) fatty acid in an amount such that the ratio of fatty isethionate ester to fatty acid is not more than 2:1, and, c) 2–15% water, said mixture being at a temperature of 40°–110° C.

Typically, the process further comprises the step of combining the isotropic mixture of the above mentioned components (a), (b) and (c) with neat soap and processing the resulting product into soap bars.

Preferably, said combination of the isotropic mixture and neat soap is performed by injection of one of said combined components into the other of said combined components. More preferably, the isotropic mixture is injected into the neat soap. Simple mixing means can be employed as an alternative to injection apparatus.

It should be noted that while the isotropic mixture is generally stable at temperatures above 40° C. the preferred temperature for performance of the method is 70°–110° C. In this temperature range the process stream is pumpable and the potential for hydrolyis is minimised.

Overall, the soap making process of the present invention can be seen as:

A) forming a liquid isotropic mixture comprising:

a) a fatty isethionate ester, b) fatty acid in an amount such that the ratio of fatty isethionate ester to fatty acid is not more than 2:1, and, c) 2–15% water, said mixture being at a temperature of 40°–110° C., B) preparing a neat soap at a temperature of 80°–95° C., and, C) combining (A) and (B) in a ratio such that the final product comprises:

a) 5–30% fatty isethionate ester, b) at least 2.5% fatty acid, c) 8–18% water, and, d) 40–80% soap, and, D) forming the product of step (C) into bars.

According to a third aspect of the present invention there are provided soap bars produced by the above-mentioned method.

In typical embodiments of the invention, the overall fatty isethionate ester content of finished soap bars does not exceed 30% wt on bar. If this figure is exceeded, the related level of fatty acid in the finished product is such that high wear rates and poor lather result. In practice, there is no critical, minimum level for the fatty isethionate ester although reduction of the level of this component leads to progressively less mild bars. In embodiments of the invention, the fatty isethionate ester level in the finished bars will generally lie between 5– 30wt % on bar, preferably between 7–15wt % on bar, and most preferably around 10wt % (i.e. 8–12wt %) on bar.

Preferred ratios of fatty isethionate ester to fatty acid fall in the range 1:1 to 2:1. Excess of fatty acid leads to high levels of fatty acid in the final product. This can be disadvantageous where the fatty acid is required to provide structure. An isotropic melt cannot be formed when the fatty acid level is too low.

In order that the present invention may be further understood, it will be illustrated hereafter by way of example and with reference to the accompanying figures which shows phase diagrams for mixtures of fatty acid, fatty isethionate ester and water, indicating the region wherein isotropic systems are formed.

Figure 2:
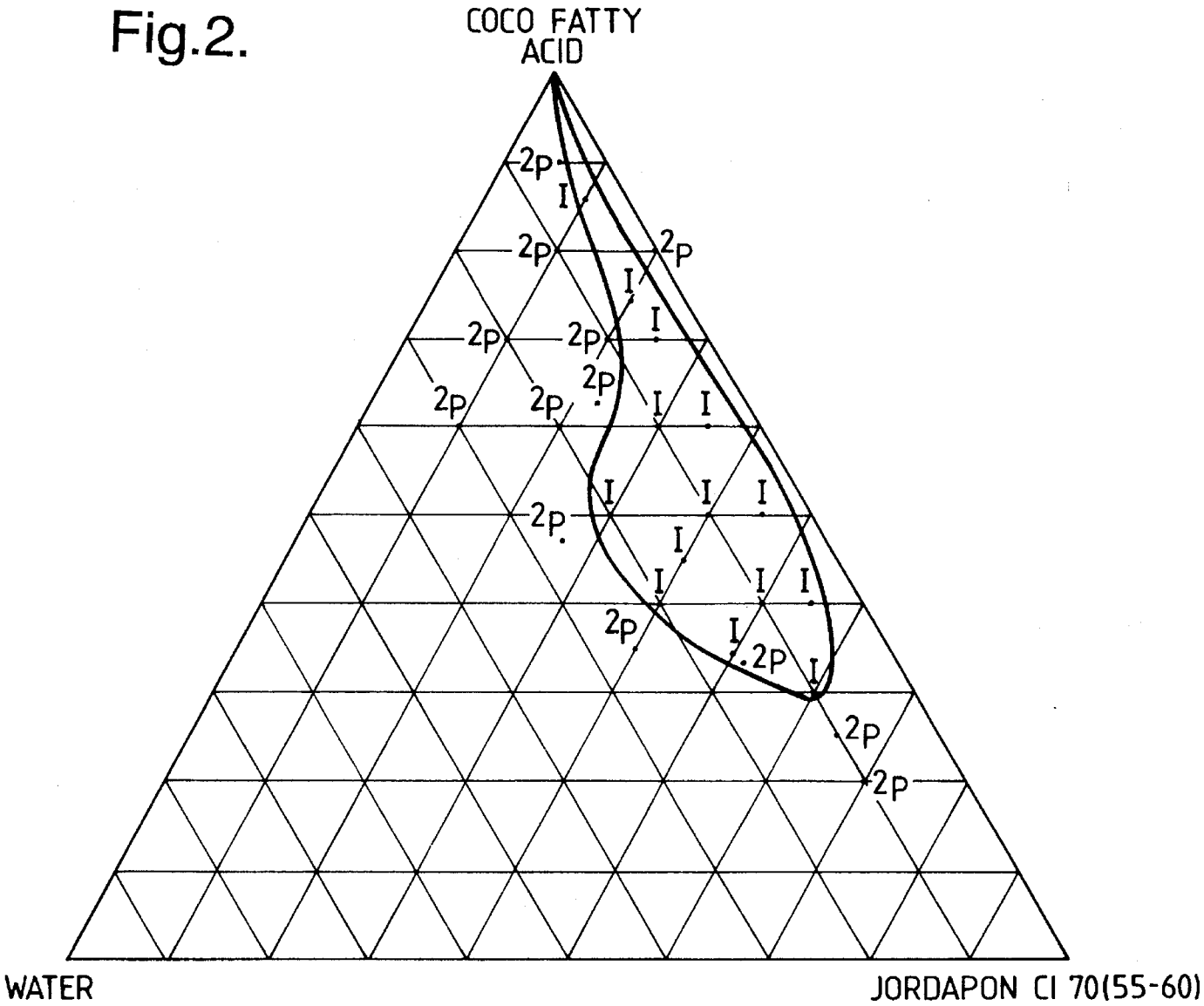
Figure 3:
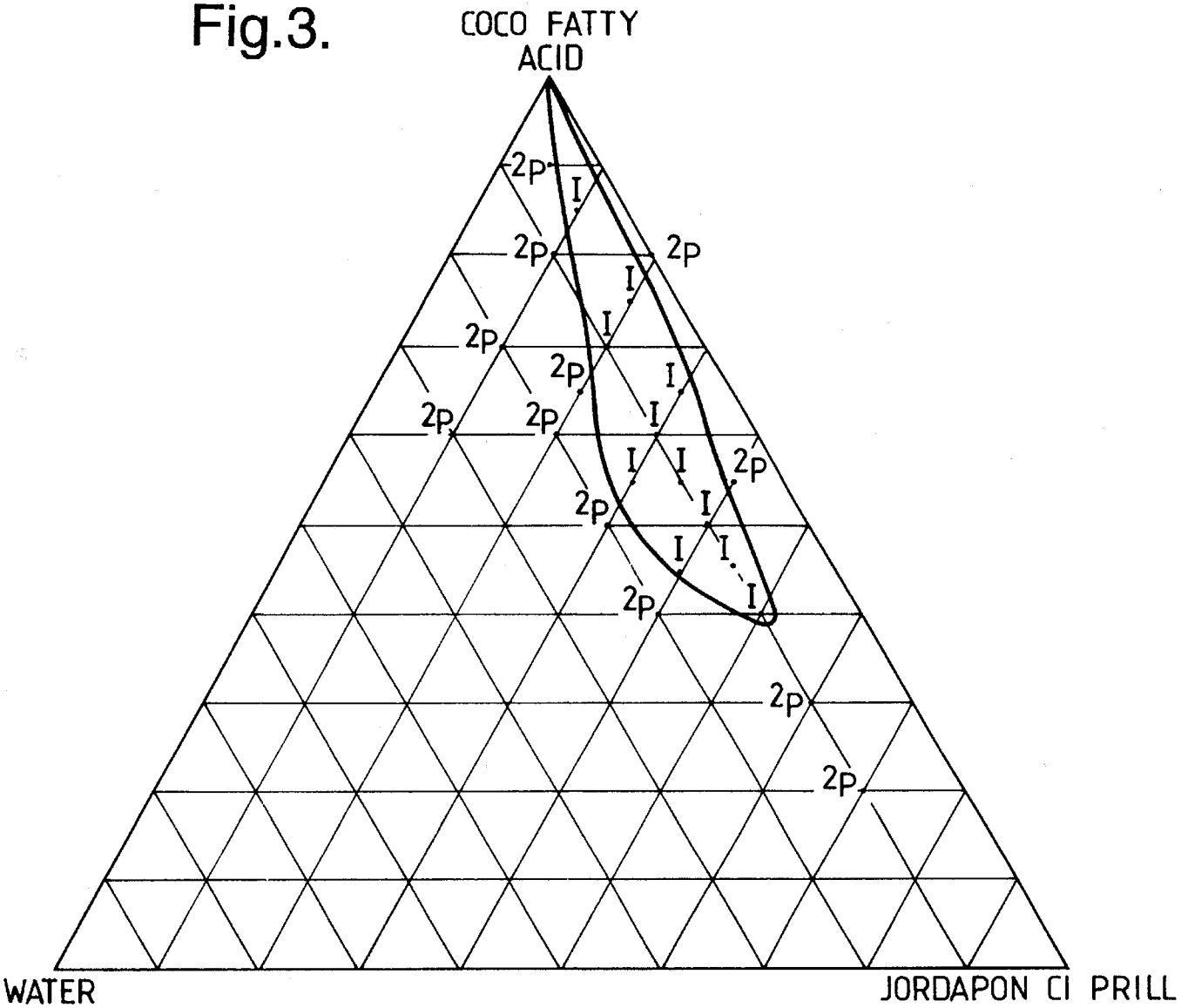

The enclosed FIGS. 1, 2 and 3 are 'phase' diagrams for mixtures of fatty acid, fatty isethionate esters and water indicating the region (I) wherein isotropic systems are formed. Region (P) is that of a multiphase system.

EXAMPLES

In FIG. 1, points 1–9 indicate embodiments of the invention as set out as examples 1–9 in table 1 below. These form an isotropic system at temperatures of 85° C. Points 10–23 are comparative examples which do not form an isotropic mixture, but form a higher viscosity, phase-separated system at 85° C.

Table 1 below gives both embodiments of the present invention and comparative examples. Composition data in the table is such that the wt % DEFI, wt % FFA and wt % water are given with respect to the isotropic mixture formed from them. DEFI is around 70% directly esterified cocoyl fatty isethionate as obtained from the Lever Brothers Company, the bulk of the remainder of the material being fatty acids and free isethionate.

Taking example 5 as representative, the isotropic mixture was formed by combination of the three components (coconut fatty acid/DEFI flake slurry plus water) in a electrically heated, thermostatted vessel at a temperature of 80° C., with mechanical stirring. The mixture was injected into a neat soap stream emerging from the heat-exchangers of a conventional vacuum soap drier. At the exit of the heat-exchangers commonly used in the soap making process, the neat soap stream is generally at a temperature of around 130° C. As is commonplace in soap making plant, a fatty acid injection port is provided at this location for the production of so called 'super-fatted' soaps. This port was used for the injection of the fatty acid/DEFI mixture.

The injected stream was mixed in-line with the neat-soap and the combined process stream sprayed into a vacuum drier and dried to a final water content of 12%. Thereafter, the process stream was milled, plodded and stamped into soap bars.

TABLE 1

| | wt % DEFI | wt % FFA | wt % water | DEFI/FFA |
|---|---|---|---|---|
| Example | | | | |
| 1 | 61 | 34 | 5 | 1.79 |
| 2 | 43 | 52 | 5 | 0.83 |
| 3 | 52 | 43 | 5 | 1.21 |
| 4 | 41 | 49 | 10 | 0.84 |
| 5 | 49 | 41 | 10 | 1.20 |
| 6 | 40 | 50 | 10 | 0.80 |
| 7 | 35 | 60 | 5 | 0.58 |
| 8 | 25 | 70 | 5 | 0.36 |
| 9 | 5 | 90 | 5 | 0.06 |
| Comparatives | | | | |
| 10 | 57 | 33 | 10 | 1.73 |
| 11 | 39 | 46 | 15 | 0.85 |
| 12 | 47 | 38 | 15 | 1.24 |
| 13 | 54 | 31 | 15 | 1.74 |
| 14 | 65 | 30 | 5 | 2.20 |
| 15 | 64 | 36 | 0 | 1.70 |
| 16 | 55 | 45 | 0 | 1.20 |

TABLE 1-continued

| | wt % DEFI | wt % FFA | wt % water | DEFI/FFA |
|---|---|---|---|---|
| 17 | 45 | 55 | 0 | 0.82 |
| 18 | 40 | 60 | 0 | 0.67 |
| 19 | 35 | 50 | 15 | 0.70 |
| 20 | 30 | 60 | 10 | 0.50 |
| 21 | 30 | 70 | 0 | 0.43 |
| 22 | 10 | 90 | 0 | 0.11 |
| 23 | 10 | 80 | 10 | 0.12 |
| 24 | 40 | 35 | 25 | |
| 25 | 28 | 46 | 26 | |

The DEFI and fatty acid content of the final product is determined by the rate of injection of the DEFI/fatty acid mixture into the soap stream. Pilot plant scale samples were produced with 9% wt DEFI and 7.5% FFA on product.

Bars according to the present invention were subjected to a so-called 'flex-wash' test as known in the industry, and were shown to be milder on the skin than conventional soap bars. In this in-vivo test, cumulative erythema scores are determined and a minimum difference of 3.33 is required for a 95% confidence interval. The test gave results as:

Conventional toilet soap (80/20): 22.67

Embodiment of example 5 : 17.87

From the above data it can be seen that the bars according to the present invention are significantly milder than the control.

FIG. 2 shows results obtained with Jordapon CI70 (55–60% active material) whereas FIG. 3 shows results obtained with Jordapon CI-Prilled (circa 80% active, 20% fatty acids, free isethioninate etc). In FIGS. 2 and 3, stable isotropic formulations are indicated by the index 'I' whereas unstable, multi-phase formulations are indicated by the index '2P'. It can be seen that the regions of stability are generally similar in shape allowing for the variation in the contents of the raw materials.

For comparison purposes, a series of products with similar levels of fatty acid and DEFI (10% wt DEFI and 7.5% on total product and approximately 12% water) were prepared by a series of routes which involved mixing the dried materials via high shear mixing.

EXAMPLE A

Milling, followed by use of a cavity transfer mixer at 35° C. and finally by vacuum plodding and stamping.

EXAMPLE B

Z blade mixer used at 58° C. followed by milling, vacuum plodding and stamping.

EXAMPLE C

Z blade mixer used at 58° C. followed by milling, vacuum plodding and stamping.

Products were assessed with regard to grit. Grit was assessed subjectively by a panel of 20 trained operators. Operators scored the bars on a scale of 1 to 5 with 1 representing smooth bars; 2: slightly sandy; 3: sandy, slightly gritty; 4: gritty and 5: very gritty. For commercial products, an acceptable score on this scale is <2. The mean score for each bar was calculated. The bars were first plunged into water at 20° C. and rotated in the hand for 30 seconds before an assessment was made.

| Example No | Grit Score |
|---|---|
| 5 | 1.1 |
| A | 3.2 |
| B | 3.2 |
| C | 2.5 |
| Control# | 1.6 |

#Control is a conventional 60/40 tallow/coconut soap base with 7.5% free fatty acid.

Control is a conventional 60/40 tallow/coconut soap base with 7.5% free fatty acid.

The results demonstrate the product of example 5 was essentially 'grit-free', scoring less than 2 on the grit/sand score. Products made by the high shear routes all had scores in excess of 2 and, therefore, are unacceptable for commercial purposes.

We claim:

1. A ternary liquid isotropic mixture which is liquid at temperatures of 40°–110° C., said mixture consisting essentially of:

a) a fatty isethionate ester having a $T_c$ in excess of 15° C., b) fatty acid in an amount such that the ratio of fatty isethionate ester to fatty acid is not more than 2:1, and, c) 2–15% wt. water.

2. A soap bar produced by a process comprising the steps of:

A) forming a ternary liquid isotropic mixture consisting essentially of a) a fatty isethionate ester, b) fatty acid in an amount such that the ratio of fatty isethionate ester to fatty acid is not more than 2:1, and, c) 2–15% water, said mixture being at a temperature of 40°–110° C., B) preparing a liquid neat soap at a temperature of 80°–95° C., and, C) combining (A) and (B) in a ratio such that the final product comprises:

a) 5–30% fatty isethionate ester b) at least 2.5% fatty acid, c) 8–18% water, and, d) 40–80% soap, and, D) forming the product of step (C) into bars.

3. A mixture according to claim 1 wherein the fatty isethionate ester (component a) is an ester of fatty acids having $C_{10}$–$C_{18}$ average chain length with isethionates.

* * * * *